US010046588B2

(12) United States Patent
Coulter

(10) Patent No.: US 10,046,588 B2
(45) Date of Patent: Aug. 14, 2018

(54) SECURITY SELF-MAILER

(71) Applicant: CRABAR/GBF, INC., Midlothian, TX (US)

(72) Inventor: Charlie Coulter, Clarksville, TN (US)

(73) Assignee: CRABAR/GBF, INC., Midlothian, TX (US)

( * ) Notice: Subject to any disclaimer, the term of this patent is extended or adjusted under 35 U.S.C. 154(b) by 211 days.

(21) Appl. No.: 15/028,776

(22) PCT Filed: Oct. 7, 2014

(86) PCT No.: PCT/US2014/059519

§ 371 (c)(1),
(2) Date: Apr. 12, 2016

(87) PCT Pub. No.: WO2015/054271

PCT Pub. Date: Apr. 16, 2015

(65) Prior Publication Data

US 2016/0236503 A1 Aug. 18, 2016

Related U.S. Application Data

(60) Provisional application No. 61/890,320, filed on Oct. 13, 2013.

(51) Int. Cl.
*B42D 15/08* (2006.01)
*B65D 27/00* (2006.01)

(52) U.S. Cl.
CPC ..... *B42D 15/085* (2013.01); *B42D 15/08* (2013.01); *B65D 27/00* (2013.01)

(58) Field of Classification Search
CPC ..... B42D 15/085; B42D 15/08
(Continued)

(56) References Cited

U.S. PATENT DOCUMENTS 5,294,041 A * 3/1994 Whiteside ..... B42D 5/026 283/116
5,366,145 A 11/1994 Sauerwine
(Continued)

FOREIGN PATENT DOCUMENTS

EP 0587315 A1 3/1994
WO WO 2011059410 A1 * 5/2011 ..... B42D 15/085
WO 2015054271 A3 4/2015

OTHER PUBLICATIONS

International Search Report and Written Opinion of KIPO for PCT/US2014/059519 dated Feb. 26, 2015, 16 pp.

*Primary Examiner* — Kyle Robert Grabowski
(74) *Attorney, Agent, or Firm* — Daniel J. Chalker; Chalker Flores, LLP

(57) ABSTRACT

A mailer includes a sheet having a front face, a rear face, a top edge and a bottom edge substantially parallel to one another, a left edge and a right edge substantially parallel to one another and substantially perpendicular to the top and bottom edges. A first, a second, and a third fold line are substantially parallel to the top and bottom edges, extending between the left edge and the right edge, and dividing the sheet into a first panel, a second panel, a third panel and a fourth panel. A protected information area is on the front face of the second panel and spaced apart from the left edge, the right edge, the first fold line and the second fold line. Four blackouts are printed on various panels to cover the protected information area.

19 Claims, 2 Drawing Sheets

(58) Field of Classification Search
USPC .... 283/116, 901; 229/92.1, 7, 313, 314, 316
See application file for complete search history.

(56) References Cited

U.S. PATENT DOCUMENTS

| | | | | | |
|---|---|---|---|---|---|
| 5,376,048 | A * | 12/1994 | Whiteside | B42D 5/026 | 283/116 |
| 5,595,404 | A * | 1/1997 | Skees | B42D 15/08 | 283/116 |
| 5,752,647 | A * | 5/1998 | Schubert | B42D 15/08 | 229/92.1 |
| 6,095,407 | A * | 8/2000 | Ward | B42D 15/08 | 229/69 |
| 6,126,064 | A * | 10/2000 | Hutchinson | B42D 15/08 | 229/313 |
| 6,460,760 | B1 * | 10/2002 | Sass | B42D 5/026 | 229/92.1 |
| 7,975,904 | B2 | 7/2011 | Yost | | |
| 2005/0006448 | A1 * | 1/2005 | Bethke | B42D 15/08 | 229/300 |
| 2005/0082354 | A1 * | 4/2005 | Black | B42D 15/085 | 229/92.1 |
| 2010/0193581 | A1 | 8/2010 | Dyer | | |
| 2010/0230477 | A1 * | 9/2010 | Dyer | B42D 15/085 | 229/92.8 |

* cited by examiner

SECURITY SELF-MAILER

CROSS REFERENCE TO RELATED APPLICATIONS

This application claims priority to, and is a National Phase Patent Application under 35 U.S.C. § 371 of International Application No. PCT/US2014/059519, filed on Oct. 7, 2014, which claims the benefit under 35 U.S.C. § 119(e) of U.S. Provisional Application No. 61/890,320 filed Oct. 13, 2013. The contents of the foregoing applications are hereby incorporated by reference in their entirety.

TECHNICAL FIELD

The present invention relates generally to the field of postal mailers and, more particularly, to a security self-mailer.

BACKGROUND ART

Current mailers containing confidential information are susceptable to various forms of manipulation or viewing that allow the confidential information to be detected without opening the mailer.

SUMMARY OF INVENTION

The present invention provides a mailer that includes a sheet having a front face, a rear face, a top edge and a bottom edge substantially parallel to one another, a left edge and a right edge substantially parallel to one another and substantially perpendicular to the top and bottom edges. A first, a second, and a third fold line are substantially parallel to the top and bottom edges, extending between the left edge and the right edge, and dividing the sheet into a first panel, a second panel, a third panel and a fourth panel. A protected information area is on the front face of the second panel and spaced apart from the left edge, the right edge, the first fold line and the second fold line. A first blackout is printed on the front face of the first panel and spaced to cover the protected information area when the first panel is folded on top of the second panel at the first fold line. A second blackout is printed on the rear face of the first panel and spaced to cover an area behind the first blackout. A third blackout is printed on the rear face of the second panel and spaced to cover an area behind the protected information area. A fourth blackout is printed on the rear face of the third panel and spaced to cover the second blackout when the third panel is folded on top of the bottom of the second panel at the second fold line.

In addition, the present invention provides a mailer that includes a sheet having a front face, a rear face, a top edge and a bottom edge substantially parallel to one another, a left edge and a right edge substantially parallel to one another and substantially perpendicular to the top and bottom edges. A first, a second, and a third fold line are substantially parallel to the top and bottom edges, extending between the left edge and the right edge, and dividing the sheet into a first panel, a second panel, a third panel and a fourth panel. A first line of weakness is substantially parallel to and spaced from the left edge, extending between the top edge and the bottom edge, and forming a first tear-off strip. A second line of weakness is substantially parallel to and spaced from the right edge, extending between the top edge and the bottom edge, and forming a second tear-off strip. A protected information area is on the front face of the second panel and spaced apart from the left edge, the right edge, the first fold line and the second fold line. A first blackout is printed on the front face of the first panel and spaced to cover the protected information area when the first panel is folded on top of the second panel at the first fold line. A second blackout is printed on the rear face of the first panel and spaced to cover an area behind the first blackout. A third blackout is printed on the rear face of the second panel and spaced to cover an area behind the protected information area. A fourth blackout is printed on the rear face of the third panel and spaced to cover the second blackout when the third panel is folded on top of the bottom of the second panel at the second fold line. A third line of weakness forms a tab having three sides around the first and second blackouts that peals back to reveal the protected information area. First adhesive areas are disposed around the protected information area. Second adhesive areas are disposed around the first blackout. Third adhesive areas are disposed on the front face of the first panel proximate to the top edge. Fourth adhesive areas are disposed on the front face of the second panel offset from the second fold line. Fifth adhesive areas are disposed on the front face of the second panel proximate to the second fold line. Sixth adhesive areas are disposed on the rear face of the fourth panel proximate to the bottom edge. Seventh adhesive areas are disposed in at least some of the first tear-off strips for holding the first, second, third and fourth panels together as the mailer is folded about the first, second and third fold lines. eighth adhesive areas are disposed in at least some of the second tear-off strips for holding the first, second, third and fourth panels together as the mailer is folded about the first, second and third fold lines.

The present invention is described in detail below with reference to the accompanying drawings.

BRIEF DESCRIPTION OF THE DRAWINGS

The above and further advantages of the invention may be better understood by referring to the following description in conjunction with the accompanying drawings, in which.

DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Figure 1A:
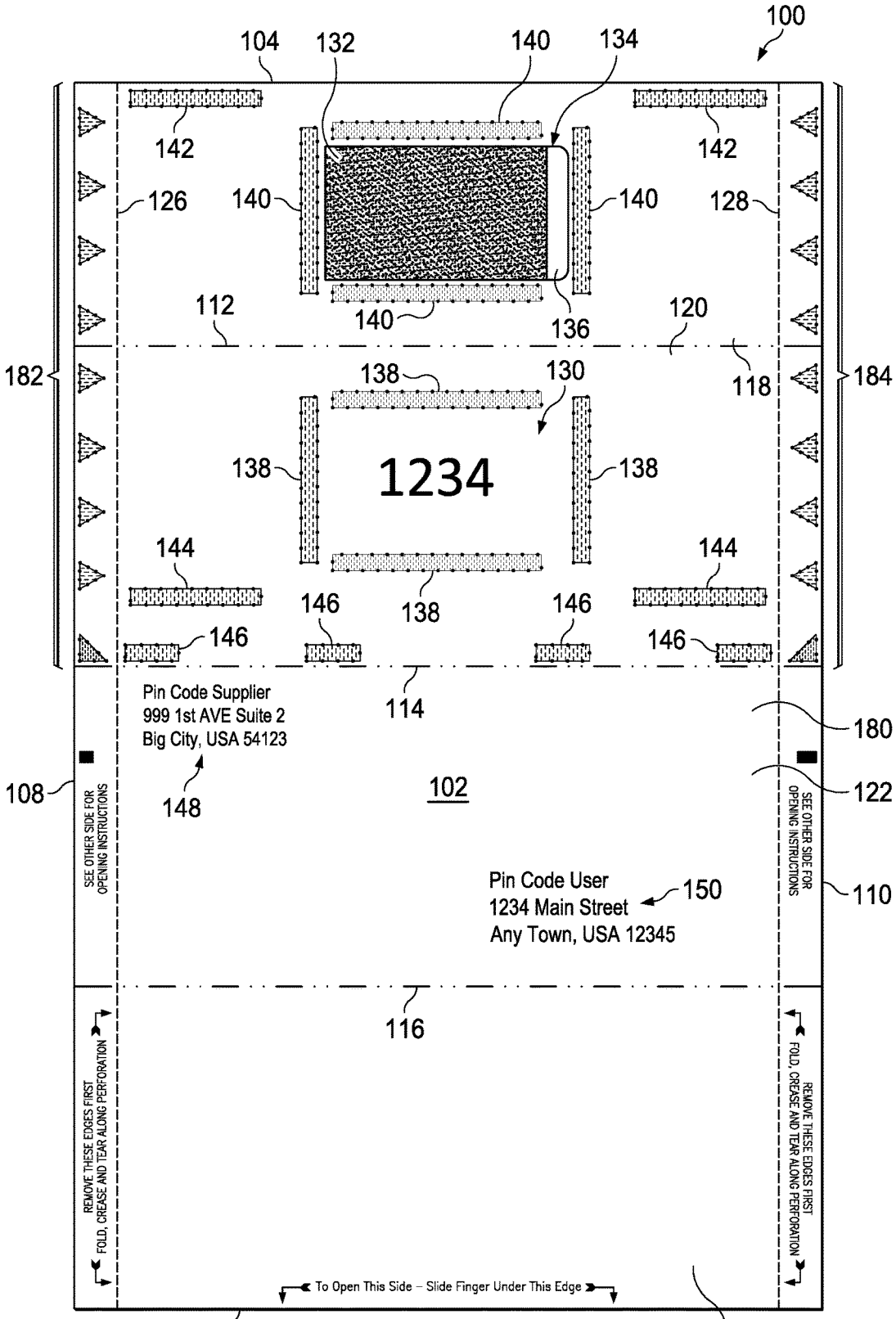
FIG. 1A is a front view of a mailer in accordance with one embodiment of the present invention.
Figure 1B:
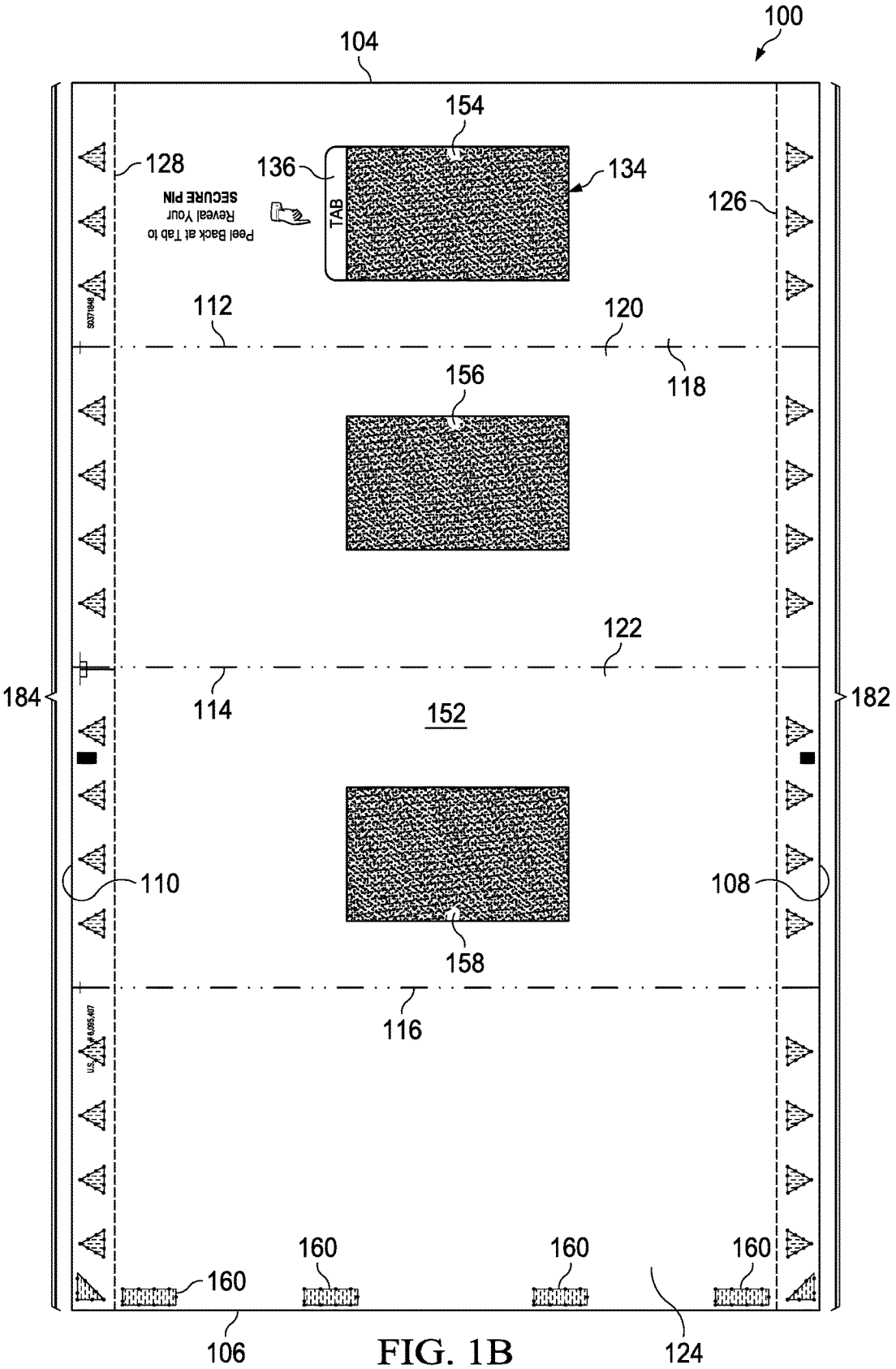
FIG. 1B is a rear view of a mailer in accordance with one embodiment of the present invention.

Now referring to FIGS. 1A and 1B, a mailer 100 in accordance with one embodiment of the present invention is shown. The mailer 100 is a sheet having a front face 102 and a rear face 152. The mailer 100 has a top edge 104 and a bottom edge 106 that are substantially parallel to one another, and a left edge 108 and a right edge 110 (as viewed from the front face 102 of FIG. 1A) that are substantially parallel to one another and substantially perpendicular to the top and bottom edges 104 and 106. First, second and third fold lines 112, 114 and 116, which may be perforated, are substantially parallel to the top and bottom edges 104 and 106, extend between the left and right edges 108 and 110, to divide the sheet into first, second, third and fourth panels 118, 120, 122 and 124. A first line of weakness (e.g., perforations, etc.) 126 is substantially parallel to and spaced apart from the left edge 108, extends between the top and bottom edges 104 and 106, and forms a first tear-off strip (left margin). A second line of weakness (e.g., perforations, etc.) 128 is substantially parallel to and spaced apart from the right edge 110, extends between the top and bottom edges 104 and 106, and forms a second tear-off strip (right margin). The first and second lines of weakness 126 and 128 are used for opening the left and right sides, respectively, of the mailer 100.

The mailer 100 includes a protected information area 130 on the front face 102 of the second panel 120 and spaced apart from the left edge 108, the right edge 110, the first fold line 112 and the second fold line 114. A first blackout 132 is printed on the front face 102 of the first panel 118 and spaced to cover the protected information area 130 when the first panel 118 is folded on top of the second panel 120 at the first fold line 112. A second blackout 154 is printed on the rear face 152 of the first panel 118 and spaced to cover an area behind the first blackout 132. A third blackout 156 is printed on the rear face 152 of the second panel 120 and spaced to cover an area behind the protected information area 130. A fourth blackout 158 is printed on the rear face 152 of the third panel 122 and spaced to cover the second blackout 154 when the third panel 122 is folded on top of the bottom of the second panel 120 at the second fold line 114. The size of the protected information area 130 and blackouts 132, 154, 156 and 158 can vary in size as required by the indicia (e.g., "1234") printed within the information area 130. The blackouts 132, 154, 156 and 158 are preferably larger than the indicia printed within the information area 130. The blackouts 132, 154, 156 and 158 (often referred to as security patterns) are provided to help obscure the indicia within the protected information area 130 from view or scrutiny when the mailer 100 is fully folded and sealed. Any suitable pattern or technique can be used for the blackouts 132, 154, 156 and 158. When the mailer 100 is fully folded, blackouts 132 and 154 are aligned with one another and obscure the area over the protected information area 130 on front face 102, and blackouts 156 and 158 are aligned with one another and obscure the area under the protected information area on rear face 152. As a result, two layers of blackouts are provided on both the front and back of the confidential area 130.

In addition, the mailer 100 includes a third line of weakness 134 forming a tab 136 having three sides around the first and second blackouts 132 and 154. The tab 136 peals back the portion of the first panel disposed within the third line of weakness 134 to reveal the protected information area 130 when the mailer 100 is opened. An addition security feature is the used of first adhesive areas 138 disposed around the protected information area 130, and second adhesive areas 140 disposed around the first blackout 132. The first and second adhesive areas 138 and 140 are aligned with one another and help prevent the first blackout 132 from being spread apart from the protected information area 130.

The front face 102 of the first panel 118 is affixed to the front face 102 of the second panel 120 using third and fourth adhesive areas 142 and 144. The third adhesive areas 142 are disposed on the front face 102 of the first panel 118 proximate to the top edge 104. The fourth adhesive areas 144 are disposed on the front face of the second panel 120 proximate to or offset from the second fold line 114. The third and fourth adhesive areas 142 and 144 are aligned with one another. In the embodiment shown in FIG. 1A, the fourth adhesive areas 144 are offset from the second fold line 114, and the first panel 118 is smaller than the second panel 120 so that fifth adhesive areas 146 are disposed on the front face 102 of the second panel 120 proximate to the second fold line 114. Sixth adhesive areas 160 are disposed on the rear face 152 of the fourth panel 124 proximate to the bottom edge 106. The fifth and sixth adhesive areas 146 and 160 are aligned with one another to affix the rear face 152 of the fourth panel 124 to the front face 102 of the second panel 120 and cover the rear face 152 of the first panel 118.

The mailer 100 also includes a return address area 148 and an outgoing address area 150 defined on the front face 102 of the third panel 122. The return address area 148 is spaced apart or offset from the first line of weakness 126 and the second fold line 114. The outgoing address area 150 is spaced apart or offset from the second line of weakness 128 and the third fold line 116. A postage area 180 is defined on the front face 102 of the third panel 122 and spaced apart from the second line of weakness 128 and the second fold line 114.

Seventh adhesive areas 182 are disposed in at least some of the first tear-off strips for holding the first, second, third and fourth panels 118, 120, 122 and 124 together as the mailer 100 is folded about the first, second and third fold lines 112, 114 and 116. As shown, the seventh adhesive areas 182 are located on the front face 102 of the first and second panels 118 and 120, and the rear face 152 of the first, second, third and fourth panels, 118, 120, 122 and 124. Eighth adhesive 184 areas disposed in at least some of the second tear-off strips for holding the first, second, third and fourth panels 118, 120, 122 and 124 together as the mailer 100 is folded about the first, second and third fold lines 112, 114 and 116. As shown, the eighth adhesive areas 184 are located on the front face 102 of the first and second panels 118 and 120, and the rear face 152 of the first, second, third and fourth panels, 118, 120, 122 and 124. When the front face 102 of the first panel 118 is folded onto the front face 102 of the second panel 120, the seventh adhesive areas 182 on the front face 102 overlap one another and the eighth adhesive areas 184 on the front face 102 overlap one another. When the rear face 152 of the second panel 120 is folded onto the rear face 152 of the third panel 122, the seventh adhesive areas 182 on the rear face 152 overlap one another and the eighth adhesive areas 184 on the rear face 152 overlap one another. When the rear face 152 of the fourth panel 120 is folded onto the rear face 152 of the first panel 118, the seventh adhesive areas 182 on the rear face 152 overlap one another and the eighth adhesive areas 184 on the rear face 152 overlap one another. Note that the seventh and eight adhesive areas 182 and 184 on the front face 102 are offset from the seventh and eight adhesive areas 182 and 184 on the rear face 152 so that the unfolded mailers 100 can be stacked without sticking to one another.

The adhesive areas each comprise corresponding patterns of spaced, patches of a pressure-activated adhesive. As shown, the patches of the first, second, third, fourth fifth and sixth adhesive areas 138, 140, 142, 144, 146 and 160 are rectangular shaped. The patches of the seventh and eighth adhesive areas 182 and 184 are triangular shaped. The patches of the seventh and eighth adhesive areas 182 and 184 on the front face 102 are spaced triangles, oriented with their bases parallel to the sides of the sheet, their apices pointing to the center of the sheet. The patches of the seventh and eighth adhesive areas 182 and 184 on the rear face 152 are spaced triangles, oriented with their bases parallel to the sides of the sheet, their apices pointing to the outside of the sheet. Note that the patches can be of any desired shape and are not limited to the rectangles and triangles shown in FIGS. 1A and 1B.

In operation, the mailers 100 are stacked. The mailer 100 is printed and then folded. Sensitive or confidential information (e.g., personal identification number (PIN), password, account information, etc.) is printed in the protected information area 130. The front face 102 of the first panel 118 is folded over the front face 102 of the second panel 120 along the fold line 112. The rear face 152 of the second panel 120 is folded over the rear face 152 of the third panel 122 along the second fold line 114. The rear face 152 of the fourth panel 124 is folded over the rear face 152 of the first panel 118 and the front face 102 of the second panel 120 along the third fold line 116. The folded mailer is then ready for mailing.

A mailing address can be printed in the outgoing address area 150. A return address can be printed or preprinted in return address area 148. Postage can be applied or preprinted in postage area 180. These areas are on the front face 102 of the third panel 122, which forms the front of the mailer 100.

The mailer 100 is opened by removing the first and second tear-off strips from the sides 108 and 110 of the mailer 100 ("remove these edges first—fold, crease and tear along perforation"). The bottom portion of the fourth panel 124 is separated from the mailer 100 at the bottom edge 106 ("to open this side—slide finger under this edge"). The fourth panel 124 is then opened to reveal the tab 136 on the rear face 152 of the first panel 118. The tab 136 is peeled back along the third line of weakness 134 to reveal the protected information area 130 and the indicia printed therein ("peal back at tab to reveal your secure pin").

Although preferred embodiments of the present invention have been described in detail, it will be understood by those skilled in the art that various modifications can be made therein without departing from the spirit and scope of the invention as set forth in the appended claims.

The invention claimed is:

1. A mailer comprising:

a sheet having a front face, a rear face, a top edge and a bottom edge substantially parallel to one another, a left edge and a right edge substantially parallel to one another and substantially perpendicular to the top and bottom edges;

a first, a second, and a third fold line substantially parallel to the top and bottom edges, extending between the left edge and the right edge, and dividing the sheet into a first panel, a second panel, a third panel and a fourth panel;

a protected information area on the front face of the second panel and spaced apart from the left edge, the right edge, the first fold line and the second fold line;

a first blackout printed on the front face of the first panel and spaced to cover the protected information area when the front face of the first panel is folded on top of the front face of the second panel at the first fold line;

a second blackout printed on the rear face of the first panel and spaced to cover an area behind the first blackout;

a third blackout printed on the rear face of the second panel and spaced to cover an area behind the protected information area; and a fourth blackout printed on the rear face of the third panel and spaced to cover the third blackout when the rear face of the third panel is folded on top of the rear face bottom of the second panel at the second fold line.

2. The mailer as recited in claim 1, further comprising:

first adhesive areas disposed around and adjacent to the protected information area; and second adhesive areas disposed around and adjacent to the first blackout.

3. The mailer as recited in claim 2, wherein the first and second adhesive areas comprise rectangular-shaped patches.

4. The mailer as recited in claim 1, further comprising:

third adhesive areas disposed on the front face of the first panel proximate to the top edge;

fourth adhesive areas disposed on the front face of the second panel offset from the second fold line;

fifth adhesive areas disposed on the front face of the second panel proximate to the second fold line; and sixth adhesive areas disposed on the rear face of the fourth panel proximate to the bottom edge.

5. The mailer as recited in claim 4, wherein the third, fourth, fifth and sixth adhesive areas comprise rectangular-shaped patches.

6. The mailer as recited in claim 1, further comprising:

a first line of weakness substantially parallel to and spaced from the left edge, extending between the top edge and the bottom edge, and forming a first tear-off strip; and a second line of weakness substantially parallel to and spaced from the right edge, extending between the top edge and the bottom edge, and forming a second tear-off strip.

7. The mailer as recited in claim 1, further comprising a third line of weakness forming a tab having three sides around the first and second blackouts that peals back to reveal the protected information area.

8. The mailer as recited in claim 1, further comprising:

seventh adhesive areas disposed in at least some of the first tear-off strips for holding the first, second, third and fourth panels together as the mailer is folded about the first, second and third fold lines; and eighth adhesive areas disposed in at least some of the second tear-off strips for holding the first, second, third and fourth panels together as the mailer is folded about the first, second and third fold lines.

9. The mailer as recited in claim 8, wherein:

the seventh adhesive areas are disposed in the first tear-off strips on the front face of the first and second panels, and the rear face of the first, second, third and fourth panels; and the eighth adhesive areas are disposed in the second tear-off strips on the front face of the first and second panels, and the rear face of the first, second, third and fourth panels.

10. The mailer as recited in claim 8, wherein the seventh and eighth adhesive areas comprise triangle-shaped patches.

11. The mailer as recited in claim 1, the first panel having a smaller area than the second panel.

12. The mailer as recited in claim 1, further comprising:

a return address area defined on the front face of the third panel being spaced from the first line of weakness and the second fold line;

an outgoing address area defined on the front face of the third panel spaced from the second line of weakness and the third fold line; and a postage area defined on the front face of the third panel spaced from the second line of weakness and the second fold line.

13. The mailer as recited in claim 1, wherein the first blackout, the second blackout, the third blackout and the fourth blackout are not visible when the mailer is folded and sealed.

14. The mailer as recited in claim 1, wherein the front face of the third panel and the front face of the fourth panel form a front exterior and a back exterior when the mailer is folded and sealed.

15. A mailer comprising:

a sheet having a front face, a rear face, a top edge and a bottom edge substantially parallel to one another, a left edge and a right edge substantially parallel to one another and substantially perpendicular to the top and bottom edges;

a first, a second, and a third fold line substantially parallel to the top and bottom edges, extending between the left edge and the right edge, and dividing the sheet into a first panel, a second panel, a third panel and a fourth panel;

a first line of weakness substantially parallel to and spaced from the left edge, extending between the top edge and the bottom edge, and forming a first tear-off strip;

a second line of weakness substantially parallel to and spaced from the right edge, extending between the top edge and the bottom edge, and forming a second tear-off strip;

a protected information area on the front face of the second panel and spaced apart from the left edge, the right edge, the first fold line and the second fold line;

a first blackout printed on the front face of the first panel and spaced to cover the protected information area when the front face of the first panel is folded on top of the front face of the second panel at the first fold line;

a second blackout printed on the rear face of the first panel and spaced to cover an area behind the first blackout;

a third blackout printed on the rear face of the second panel and spaced to cover an area behind the protected information area;

a fourth blackout printed on the rear face of the third panel and spaced to cover the third blackout when the rear face of the third panel is folded on top of the rear face of the second panel at the second fold line;

a third line of weakness forming a tab having three sides around the first and second blackouts that peals back to reveal the protected information area;

first adhesive areas disposed around and adjacent to the protected information area;

second adhesive areas disposed around and adjacent to the first blackout;

third adhesive areas disposed on the front face of the first panel proximate to the top edge;

fourth adhesive areas disposed on the front face of the second panel offset from the second fold line;

fifth adhesive areas disposed on the front face of the second panel proximate to the second fold line;

sixth adhesive areas dispose on the rear face of the fourth panel proximate to the bottom edge;

seventh adhesive areas disposed in at least some of the first tear-off strips for holding the first, second, third and fourth panels together as the mailer is folded about the first, second and third fold lines;

eighth adhesive areas disposed in at least some of the second tear-off strips for holding the first, second, third and fourth panels together as the mailer is folded about the first, second and third fold lines;

wherein the first blackout, the second blackout, the third blackout and the fourth blackout are not visible when the mailer is folded and sealed; and wherein the front face of the third panel and the front face of the fourth panel form a front exterior and a back exterior when the mailer is folded and sealed.

16. The mailer as recited in claim 15, wherein:

the seventh adhesive areas are disposed in the first tear-off strips on the front face of the first and second panels, and the rear face of the first, second, third and fourth panels; and the eighth adhesive areas are disposed in the second tear-off strips on the front face of the first and second panels, and the rear face of the first, second, third and fourth panels.

17. The mailer as recited in claim 15, wherein:

the first, second, third, fourth, fifth and sixth adhesive areas comprise rectangular-shaped patches; and the seventh and eighth adhesive areas comprise triangle-shaped patches.

18. The mailer as recited in claim 15, the first panel having a smaller area than the second panel.

19. The mailer as recited in claim 15, further comprising:

a return address area defined on the front face of the third panel being spaced from the first line of weakness and the second fold line;

an outgoing address area defined on the front face of the third panel spaced from the second line of weakness and the third fold line; and a postage area defined on the front face of the third panel spaced from the second line of weakness and the second fold line.

* * * * *